US005832737A

United States Patent [19]

Moilanen

[11] Patent Number: 5,832,737

[45] Date of Patent: Nov. 10, 1998

[54] GAS ACTUATED SLIDE VALVE IN A SCREW COMPRESSOR

[75] Inventor: John R. Moilanen, La Crescent, Minn.

[73] Assignee: American Standard Inc., Pistaway, N.J.

[21] Appl. No.: 763,775

[22] Filed: Dec. 11, 1996

[51] Int. Cl.[6] ..... F25B 49/02; F04B 49/02; F04C 18/16; F04C 29/10

[52] U.S. Cl. ..... 62/228.5; 418/1; 418/201.2; 417/310; 417/440

[58] Field of Search ..... 62/228.5; 417/310, 417/440; 418/1, 201.2

[56] References Cited

U.S. PATENT DOCUMENTS 5,063,750 11/1991 Englund ..... 418/201.2

FOREIGN PATENT DOCUMENTS 60-164693 8/1985 Japan ..... 418/201.2

*Primary Examiner*—John J. Vrablik

*Attorney, Agent, or Firm*—William J. Beres; William O'Driscoll; Peter D. Ferguson

[57] ABSTRACT

The position of a slide valve in a screw compressor in a refrigeration system is controlled using a gaseous medium sourced from two or more sources of such fluid, both of which are in open flow communication with the slide valve actuating piston when the slide valve load solenoid is open. Preferred gas sources are a closed compression pocket in the working chamber of the compressor and the discharge passage downstream of the compressor's working chamber. Gas at sufficiently high pressure is available whenever the compressor is operating to ensure that the compressor will load under all conditions within the compressor's operating envelope.

32 Claims, 5 Drawing Sheets

GAS ACTUATED SLIDE VALVE IN A SCREW COMPRESSOR

BACKGROUND OF THE INVENTION

The present invention relates to the compression of gas in a rotary compressor. More particularly, the present invention relates to control of the position of a slide valve in a refrigeration screw compressor by the use of a gaseous medium available from more than one source when the compressor is in operation.

Compressors are used in refrigeration systems to raise the pressure of a refrigerant gas from an evaporator to a condenser pressure (more generically referred to as suction and discharge pressures respectively) which permits the ultimate use of the refrigerant to cool a desired medium. Many types of compressors, including rotary screw compressors, are commonly used in such systems. Rotary screw compressors employ male and female rotors mounted for rotation in a working chamber. The working chamber in a screw compressor is a volume shaped as a pair of parallel intersecting flat-ended cylinders closely toleranced to the exterior dimensions and shapes of the intermeshed screw rotors which are disposed therein.

A screw compressor has low and high pressure ends which respectively define suction and discharge ports that open into the working chamber. Refrigerant gas at suction pressure enters the suction port from a suction area at the low pressure end of the compressor and is delivered to a chevron shaped compression pocket formed between the intermeshed rotors and the interior wall of the working chamber.

As the rotors rotate, the compression pocket is closed off from the suction port and gas compression occurs as the pocket's volume decreases. The compression pocket is circumferentially and axially displaced to the high pressure end of the compressor by the rotation of the rotors where it comes into communication with the discharge port.

Screw compressors most typically employ slide valve arrangements by which the capacity of the compressor is controlled over a continuous operating range. The valve portion of a slide valve assembly is disposed within and constitutes a part of the rotor housing. Certain surfaces of the valve portion of the slide valve assembly cooperate with the rotor housing to define the working chamber of the compressor.

Slide valves are axially moveable to expose a portion of the working chamber and the rotors therein to a location within a screw compressor, other than the suction port, which is at suction pressure. As a slide valve opens to greater and greater degrees, a larger portion of the working chamber and the screw rotors therein are exposed to suction pressure. The portion of the rotors and working chamber so exposed is prevented from engaging in the compression process and the compressor's capacity is proportionately reduced.

The positioning of a slide valve between the extremes of the full load and unload positions is relatively easily controlled as is, therefore, the capacity of the compressor and the system in which it is employed. Historically, slide valves have been positioned hydraulically using oil which has a multiplicity of other uses within the compressor.

In refrigeration applications, such other uses of oil in a screw compressor include bearing lubrication and the injection of such oil into the gas undergoing compression in the working chamber of the compressor for both sealing and gas cooling purposes. In that regard, injected oil acts as a sealant between the meshing screw rotors and between the rotors and the interior surface of the working chamber. It also lubricates and prevents excess wear between the rotors themselves. Finally, injected oil is used to cool refrigerant gas undergoing compression which, in turn, reduces thermal expansion in the compressor and allows for tighter rotor to working chamber clearances at the outset.

Such oil is most typically sourced from an oil separator where discharge pressure is used to drive oil to compressor injection ports and bearing surfaces and to control the position of the compressor's slide valve. In each case, the pressure differential between the relatively higher pressure source of the oil (the oil separator) and a location within the compressor which is at a relatively lower pressure is taken advantage of to drive oil from the separator to the compressor and to return oil, after its use, to the oil separator.

In that regard, oil which has been used for its intended purpose in a screw compressor is vented or drained from the location of its use to a relatively lower pressure location within the compressor or in the system in which the compressor is employed. In the typical case, such oil is vented or drained to or is used, in the first instance, in a location which contains refrigerant gas at suction pressure or at some pressure which is intermediate compressor suction and discharge pressure.

Such oil mixes with and becomes entrained in the refrigerant gas in the location to which it is vented, drained or used and is delivered back to the oil separator, at discharge pressure, in the stream of compressed refrigerant gas discharged from the compressor. The oil is separated from the refrigerant gas in the separator and is deposited in the sump therein. It is then re-directed, most often using the discharge pressure which exists in the oil separator, back to the compressor locations identified above for further use.

Even after the occurrence of the separation process, oil in the sump of an oil separator will contain refrigerant gas bubbles and/or quantities of dissolved refrigerant. The separated oil may, in fact, contain from 10–20% refrigerant by weight depending upon the solubility properties of the particular oil and refrigerant used.

One difficulty and disadvantage in the use of oil to hydraulically position the slide valve in a screw compressor relates to the fact that the oil will, as noted above, typically contain at least some dissolved refrigerant and/or bubbles of refrigerant gas. As a result of the use of such fluid to hydraulically position the piston by which the compressor slide valve is actuated, slide valve response can sometimes be inconsistent, erratic and/or slide valve position can drift as dissolved refrigerant entrained in the hydraulic fluid vaporizes (so-called "out gassing") or as entrained refrigerant gas bubbles collapse.

The out-gassing of refrigerant from the hydraulic fluid, which can occur when the pressure in the cylinder in which the slide valve actuating piston is housed is vented to unload the compressor, and/or the collapse of refrigerant gas bubbles entrained in such hydraulic fluid causes a volumetric change in that fluid. That, in turn, affects the ability of the fluid to maintain the slide valve in a desired position or to properly position the slide valve in the first instance. Further, under certain conditions, such as where ambient temperatures at compressor startup cause system pressures downstream of the compressor discharge port to be lower than the pressure of gas undergoing compression in certain portions of the compressor's working chamber, the pressure in the oil separator may be insufficient to cause the slide valve to move to load the compressor or to be sufficiently responsive for safe and reliable compressor operation.

Still another disadvantage in the use of oil to hydraulically position the slide valve in a refrigeration screw compressor relates to the fact that the quantity of refrigerant gas bubbles and dissolved liquid refrigerant contained therein varies with time and with the characteristics and composition of the particular batch of lubricant delivered to the slide valve actuating cylinder. In that regard, slide valves are most typically controlled through a supposition that the opening of a load or unload solenoid valve for a predetermined period of time results in the movement of a predetermined volume of fluid and slide valve movement that is repeatable and consistent with that period of time. That supposition is, in turn, predicated on the supposition that the characteristics and composition of the oil directed to or vented from the slide valve actuating cylinder during such a period of time is consistent.

However, because of the inconsistency in the characteristics and composition of the oil supplied to and vented from the slide valve actuation cylinder with respect to the nature and amount of refrigerant contained therein, slide valve movement during any particular time period is not precisely consistent, repeatable or predictable. This lack of consistency and repeatability, from the control standpoint, is disadvantageous and reduces the efficiency of the compressor.

As will be appreciated from the content of U.S. Pat. No. 5,509,273, assigned to the assignee of the present invention and incorporated herein by reference, arrangements for controlling slide valve position in a screw compressor by the use of a gaseous medium rather than hydraulic medium offer significant advantages. An arrangement is disclosed in that patent which selectively sources refrigerant gas, by the movement and interaction of certain parts and components, from the one of two sources of gas within the compressor or the system in which the compressor is employed which is at higher pressure. It has been found that the repetitive shifting of the source of such gas from one of multiple sources to another by the positioning of a moveable member may be disadvantageous to the extent that moveable parts, such as springs, break or components wear. Such circumstances have the potential to reduce the advantages, reliability and degree of control of slide valve positioning achieved by such systems as a result of gas leakage across worn sealing surfaces or component malfunction through the disability of a component to be properly positioned.

In that regard, testing of the shuttle check valve arrangement of the '273 patent suggests that over a number of cycles, seating surfaces may wear due to repetitive impact of moving parts and/or springs may break. As a result, leakage paths can be formed across surfaces which would otherwise act as sealing surfaces. Further, the breakage of components such as springs or other moving parts has the potential to render assemblies such as the shuttle check valve of the '273 patent incapable of operating or of blocking the flow of gas which is necessary to actuate the compressor slide valve or maintain its position.

The need therefore exists for an arrangement by which to control the position of a slide valve in a refrigeration screw compressor by the use of a gaseous medium which eliminates the disadvantages associated with the use of hydraulic fluid to do so, which permits the more precise and consistent control of slide valve position under foreseeable compressor and system operating conditions within the compressor's design operating envelope and which eliminates moving parts that can, through breakage or wear, lead to loss of or reduced slide valve control.

SUMMARY OF THE INVENTION

It is an object of the present invention to control the position of a slide valve in a screw compressor using a gas rather than a hydraulic fluid.

It is a further object of the present invention to employ refrigerant gas rather than hydraulic fluid in the positioning of a slide valve in a refrigeration screw compressor to ensure that the quantity and consistency of the actuating fluid delivered to or vented from the slide valve actuating cylinder during a predetermined period of time is repeatable.

It is a further object of the present invention to eliminate the reduced responsiveness associated with the use of system lubricant, in which liquid refrigerant and refrigerant gas bubbles exist, as the actuating fluid by which to hydraulically position a slide valve in a screw compressor.

It is a further object of the present invention to provide an arrangement by which responsive and precise control of the position of a slide valve in a screw compressor is achieved when system operating conditions result in the creation of pressures internal of the compressor which are greater than system pressures downstream thereof.

In that regard, it is a particular object of the present invention to provide slide valve control using the gas pressure available in a compression pocket in the working chamber of a screw compressor under the circumstance where gas pressure in the pocket exceeds gas pressure downstream of the working chamber.

It is a still further object of the present invention to control the position of a slide valve in a screw compressor by the use of gas sourced from two or more locations both of which are available and in open flow communication with the slide valve actuating piston whenever an actuating solenoid is opened.

It is a still further object of the present invention to eliminate the use of moving parts, the wear associated with their movement and the gas leakage resulting from such wear which has been found to develop in earlier gas-actuated slide valve arrangements for screw compressors.

These and other objects of the present invention, which will be appreciated from the following Description of the Preferred Embodiment and the attached Drawing Figures, are achieved in a screw compressor having a slide valve the position of which is controlled through the use of the working fluid of the system in which the compressor is employed. The working fluid, in its gaseous form, is sourced from at least two different locations within the compressor or the system in which the compressor is employed both of which sources are in open flow communication with the slide valve actuating piston when the slide valve load solenoid is open. The preferred sources of gas are a closed compression pocket in the working chamber of the compressor and the discharge passage leading away therefrom.

The compressor slide valve is connected by a rod to its actuating piston which is slideably disposed in an actuating cylinder. Load and unload solenoid valves operate and are controlled to admit gaseous fluid to or vent fluid from the actuating cylinder so as to position the slide valve such that the compressor produces compressed refrigerant gas at a rate in accordance with the demand on the system in which the compressor is employed. The load solenoid valve is in open flow communication with two different sources of refrigerant gas through a common conduit. By opening the load solenoid valve, gas is admitted to the cylinder in which the slide valve actuating piston is disposed causing, in turn, the slide valve to move in a direction which further loads the compressor.

A restrictor is preferably disposed between the multiple sources of gas and the load solenoid. The restrictor acts to regulate the flow of gas available from the two sources in a manner which ensures that gas at a pressure sufficient to load the compressor is continuously available to do so under all conditions the compressor is expected to operate under (its so-called operating envelope).

A primary advantage of the present invention, in addition to the fact that it uses no moving parts, is its ability to load the compressor by positioning the slide valve assembly under so-called "hot start" conditions. Hot start conditions exist when a refrigeration system must be started under ambient conditions which cause initial condenser temperatures to be relatively cool, either approaching or below evaporator temperatures, and initial evaporator temperatures to be relatively hot, either approaching or above condenser temperatures. In prior art systems, where hydraulic fluid from the system oil separator is used to position the compressor slide valve, hot start conditions many times prevented the buildup of sufficient pressure within the oil separator to drive oil out of the separator with sufficient force to position the slide valve out of its unload position quickly enough. As a result, the refrigeration system might repetitively shut down prior to achieving steady state operation due to insufficient oil pressure, traceable back to temperature conditions within and around the system.

Another significant advantage of the present invention is its ability to control the position a slide valve in a more consistent and repeatable manner thereby enhancing the efficiency of the compressor under varying operating conditions. This is because the amount and composition of the refrigerant gas delivered to the slide valve actuating cylinder during a predetermined period of time is more quantifiable and consistent than is the case with a hydraulic fluid that contains a variable and unpredictable amount of refrigerant, either in gas bubble or dissolved form in operation.

Further, and as mentioned above, because the restrictor arrangement of the present invention makes no use of moving parts, wear and breakage are eliminated making this control arrangement more reliable than prior arrangements.

DESCRIPTION OF THE DRAWING FIGURES

DESCRIPTION OF THE PREFERRED EMBODIMENT

Figure 1:
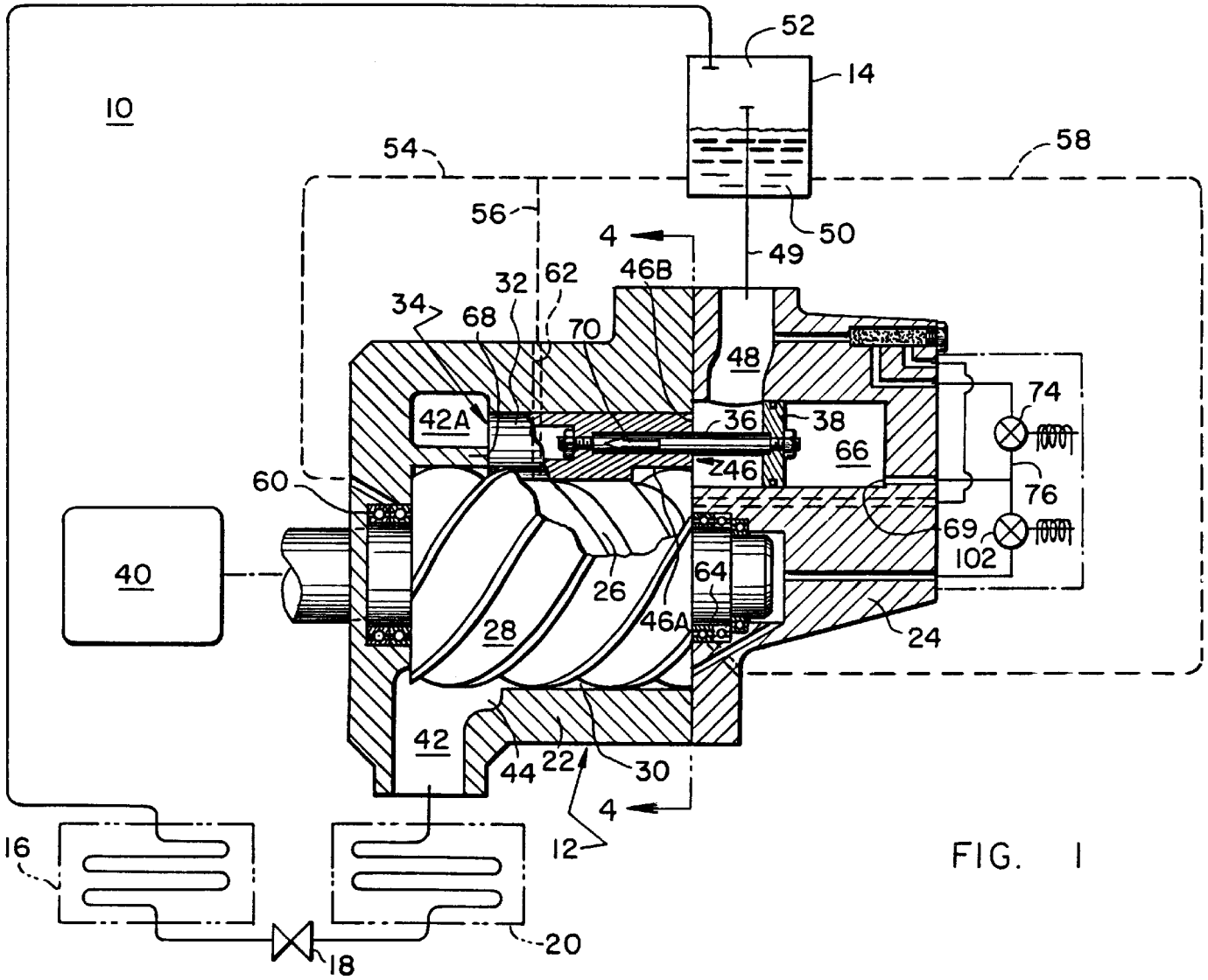
FIG. 1 is a cross-section/schematic view of the screw compressor slide valve control arrangement of the present invention.

Referring first to FIG. 1, refrigeration system 10 is comprised of a compressor assembly 12, an oil separator 14, a condenser 16, an expansion device 18 and an evaporator 20 all of which are serially connected for the flow of refrigerant therethrough. Compressor assembly 12 includes a rotor housing 22 and a bearing housing 24 which together are referred to as the compressor housing. A male rotor 26 and a female rotor 28 are disposed within the working chamber 30 of the compressor.

Working chamber 30 is cooperatively defined by rotor housing 22, bearing housing 24 and the valve portion 32 of slide valve assembly 34. Slide valve assembly 34, which in the preferred embodiment is a so-called capacity control slide valve assembly, is additionally comprised of connecting rod 36 and actuating piston 38. One of male rotor 26 or female rotor 28 is driven by a prime mover such as electric motor 40.

Refrigerant gas at suction pressure is directed from evaporator 20 to communicating suction areas 42 and 42A defined in the low pressure end of compressor 12. Gas at suction pressure flows into suction port 44, in this case underneath the rotors and out of area 42, and enters a compression pocket defined between rotors 26 and 28 and the interior surface of working chamber 30. By the counter rotation and meshing of the rotors, the compression pocket is reduced in size and is circumferentially displaced to the high pressure end of the compressor where then compressed gas flows out of the working chamber through discharge port 46 and into discharge passage 48.

With reference to discharge port 46 and to discharge ports in screw compressors in the general sense, discharge port 46 is comprised of two portions, the first being radial portion 46A which is formed on the discharge end of valve portion 32 of the slide valve assembly and the second being axial portion 46B which is formed in the discharge face of the bearing housing. The geometry and interaction of discharge port portions 46A and 46B with valve portion 32 of the slide valve assembly controls the capacity of compressor 12 and in many respects, its efficiency.

In that regard, both portions of discharge port 46 affect compressor capacity until the slide valve assembly 34 unloads far enough such that radial discharge portion 46A is no longer located over the screw rotors. In that condition it is only the axial port which actively determines compressor capacity. Therefore, during compressor startup, when slide valve assembly 34 is in the full unload position, the axial portion of discharge port 46 will be the only active portion of the discharge port.

Discharge gas, which has oil entrained in it, is directed out of discharge port 46 and discharge passage 48, through connecting conduit 49, to oil separator 14. The oil is there separated from the compressed refrigerant gas and settles into sump 50. The discharge pressure in the gas portion 52 of oil separator 14 acts on the oil in sump 50 to drive such oil into and through supply lines 54, 56 and 58 to various locations within compressor 12 that require lubrication, sealing or cooling. For example, oil supply line 54 provides oil to lubricate bearing 60 while supply line 56 directs oil to injection passage 62 in the rotor housing for sealing and gas cooling purposes. Supply line 58 directs oil to bearing 64 at the high pressure end of the compressor for lubrication purposes.

It is to be understood that discharge pressure is the pressure to which gas is compressed in and is discharged from the working chamber of the compressor. Under some operating conditions and as will subsequently be discussed, pressures downstream of discharge port 46 can be less than the pressure to which gas is compressed in and discharged from the compressor's working chamber. When conditions are such that pressures downstream of the compressor discharge port are less than the discharge pressure of gas as it exits the discharge port, the pressure in the gas discharged from the working chamber will fall accordingly as the gas discharged from the working chamber of the compressor mixes and equalizes pressures with the gas downstream of the discharge port. As such, in one sense, discharge pressure is the pressure at which gas issues from the working chamber through the discharge port of a compressor after having undergone compression within the compressor's compression mechanism. In a system sense, discharge pressure is the pressure at which compressed gas is delivered from the compressor to components downstream of the compressor for use within the system. The two are not necessarily the same (although they can be) and, as will subsequently be discussed, the latter can be lower than the former.

Slide valve actuating piston 38 is disposed in actuating cylinder 66 within bearing housing 24. As will be appreciated, the position of the slide valve actuating piston within cylinder 66 is determinative of the position of valve portion 32 of the slide valve assembly within the compressor housing and within the rotor housing 22 in particular. Because of the relative surface areas of the faces of valve portion 32 and piston 38 that are exposed to discharge pressure in discharge passage 48 and because the end face of valve portion 32 which abuts slide stop 68 of the compressor is exposed to suction pressure while the face of piston 38 facing into cylinder 66 is selectively acted upon by gaseous fluid at discharge pressure (or higher), the admission of gaseous fluid to cylinder 66 through aperture 69 will cause slide valve movement in the direction of arrow 70 to load the compressor.

In FIG. 1, slide valve assembly 34 is illustrated in the full load position with valve portion 32 of the slide valve assembly in abutment with slide stop 68. In that position, working chamber 30 and the male and female screw rotors are directly exposed to suction area 42 of the compressor only through suction port 44.

It will be appreciated that when slide valve assembly 34 is positioned such that valve portion 32 is moved away from slide stop 68, working chamber 30 and the upper portions of male rotor 26 and female rotor 28 are directly exposed to suction area 42A in the rotor housing. The rotors are additionally exposed to suction area 42 through suction port 44. The exposure of upper portions of male rotor 26 and female rotor 28 renders them incapable of participating in the definition of a closed compression pocket or in the compression process and the compressor's capacity is accordingly reduced.

Figure 2:
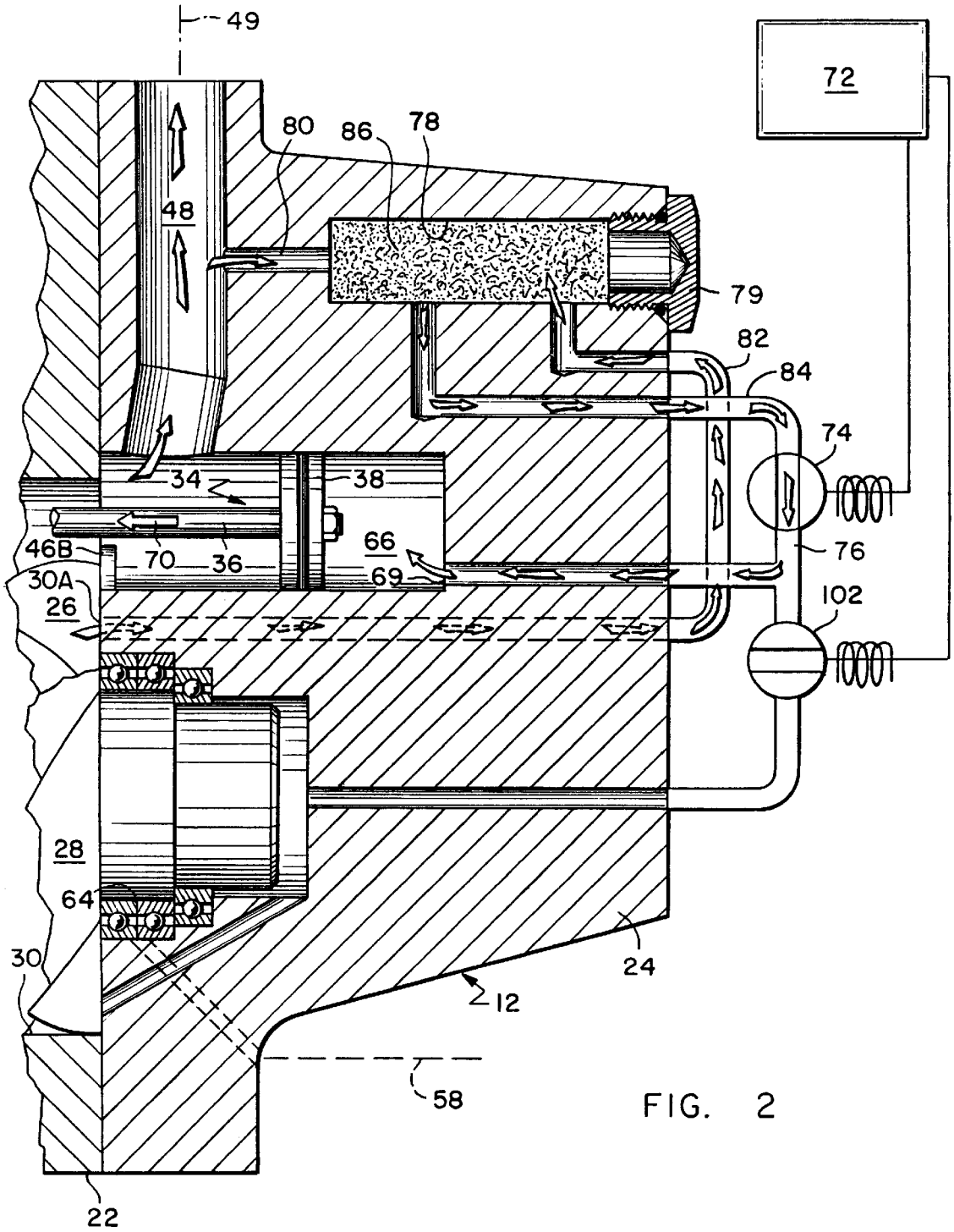
FIG. 2 is an enlarged view of the bearing housing portion of the compressor of FIG. 1 illustrating an open load solenoid and the sourcing of slide valve actuating fluid to load the compressor from two gas sources both of which are in open flow communication with the slide valve actuating piston.
Figure 4:
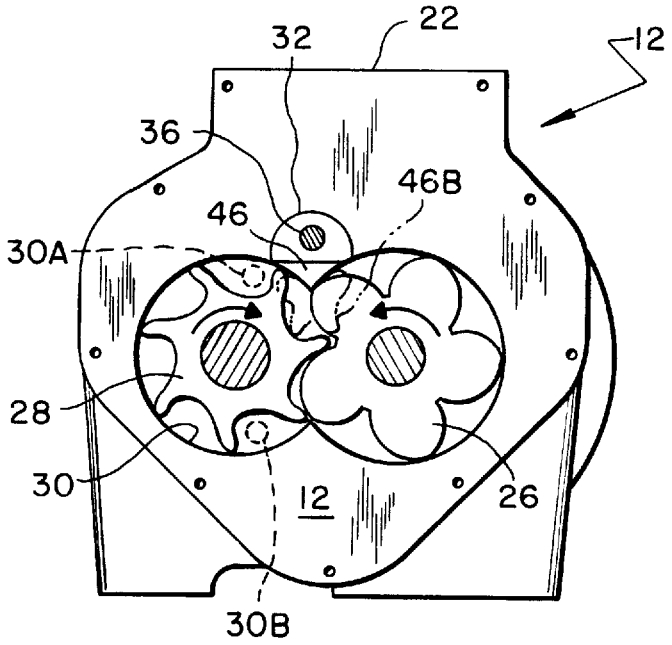
FIG. 4 is taken along line 4—4 of FIG. 1.

Referring additionally now to FIGS. 2 and 4, controller 72 is electrically connected to load solenoid valve 74. Load solenoid valve 74 is in communication with slide valve actuating cylinder 66 via passage 76 and aperture 69. A bore 78, which is closed by closure nut 79, is defined in rotor housing 24 and is in open flow communication with discharge passage 48 through passage 80, with working chamber 30 through passage 82 and with load solenoid valve 74 through passage 84.

Disposed in bore 78 in the preferred embodiment is a sintered bronze plug 86 which, by its nature, is porous and permits the flow of gas therethrough. Because of its porosity, plug 86 acts both to restrict and regulate the flow of gas through bore 78 and as a filter by which to prevent particulate or other foreign matter in the gas which flows through bore 78 from reaching load solenoid valve 74.

It will be noted from FIG. 2 that passage 82 is in open flow communication with a closed compression pocket in working chamber 30 through opening 30A and with bore 78. Opening 30A is located (see 30A in phantom in FIG. 4) so as to communicate gas out of the closed compression pocket just prior to the opening of that compression pocket to discharge port 46 when the average pocket pressure is at its highest. Opening 30A may be located on either the male or female rotor side to the working chamber, so long as it is properly positioned for communication with the closed compression pocket, and could open radially into the compression pocket rather than through the end face of the working chamber (as shown) such as by the use of radial passages (not shown) drilled into and through the rotor housing and/or slide portion of the slide valve.

It is to be noted that rather than communicate with discharge passage 48 of the compressor via passage 80, passage 80 could run from bore 78 directly to gas portion 52 of oil separator 14 or to the conduit 49 connecting discharge passage 48 of the compressor to the oil separator. In that regard, the present invention contemplates that one source of gas for slide valve actuation will be any location in the system in which the compressor is employed through which discharge gas passes prior to a purposeful reduction in its pressure, such as occurs in condenser 16.

When the pressure in the closed compression pocket with which passage 82 communicates is higher than the pressure in discharge passage 48, an "overcompression" circumstance will exist. That circumstance typically occurs when system pressures downstream of the discharge port of the compressor are relatively low as a result of the ambient conditions in which the refrigeration system 10 is operating or at compressor/system startup. While these conditions are not "normal", "steady-state" operating conditions, they do fall within the compressor's operating envelope and the compressor must be designed to contend with them.

As has been noted, the slide valve assembly is positioned to the full unload position when the compressor shuts down so that the current drawn by the compressor motor when the compressor next starts up remains within limits. As a result, whenever compressor 12 is called on to start as a result of a need to cool a heat load, there will be a need to move slide valve assembly in a direction which loads the compressor as soon as is possible.

When the pressure of the gas in working chamber 30 in the vicinity of aperture 26 is higher than the pressure of the gas in discharge passage 48, the higher pressure gas from the working chamber will flow into bore 78, in opposition to the relatively lower pressure gas which is likewise available to bore 78 through passage 80. As a result, gas at the highest pressure available under such conditions, in this case sourced from working chamber 30, is directed to and operates on slide valve actuating piston 38 to urge it in the direction of arrow 70 so as to load the compressor. In the event that during the loading process the pressure of gas in discharge passage 48 comes to exceed that of the gas in the location opening 30A in the compressor's working chamber, the source of the gas employed to load the compressor will shift automatically and without movement of any compressor part or component to discharge passage 48.

At such time as the slide valve assembly is positioned in the direction of arrow 70 to the extent that compressor 12 is loaded in accordance with the demands on it, controller 72 closes load solenoid valve 74 thereby isolating cylinder 66 from passage 84 and from its sources of actuating fluid. The gas trapped in cylinder 66 by the closure of load solenoid valve 74 maintains the position of piston 38 and slide valve assembly 34 constant until load solenoid valve 74 is next opened or until unload solenoid valve 102 is opened as will further be described.

As alluded to above, at such time as more typical steady-state operating conditions are achieved, the pressure in discharge passage 48 will come to exceed the pressure in the closed pocket in working chamber 30 at the location of port 30A. That in turn will cause the pressure of gas available to bore 78 through passage 80 to exceed the pressure of gas available to bore 78 through passage 82. When load solenoid 74 opens under this condition it will be the now relatively higher pressure gas from discharge passage 48 which makes its way through passage 80, bore 78 and passage 84 to urge slide valve piston 38 in a direction which loads the compressor. Such gas will act in opposition to the now relatively lower pressure gas available to bore 78 through passage 82 and will be at sufficiently high pressure to move the slide valve assembly to load the compressor.

Although sintered plug 86 will act to restrict and regulate the flow of gas into and through bore 78, its material characteristics are selected so as to ensure that a sufficient flow of gas at sufficiently high pressure is provided to slide valve actuating cylinder 68 to ensure the movement of piston 38 in a direction which loads the compressor under all conditions within the compressor's operating envelope. An additional benefit to the use of a plug fabricated of a sintered material, such as bronze, is that its porosity will permit a restricted but adequate flow of gas through it for slide valve actuating purposes but will trap particulate and debris that might be found in the gas stream that could damage or lodge in the load solenoid.

Theoretically, the need for a restrictor such as plug 86 might be eliminated by sizing the conduits through which each of the two sources of gas must flow prior to the convergence of the individual flow paths defined by those conduits into a single flow path upstream of load solenoid 74. However, because of pressure conditions that change continuously and rapidly during critical periods of compressor operation and because the two sources of gas are in opposition to each other where they converge, it is preferable and significantly easier to provide a restrictor, such as plug 86, which acts to "regulate" the flow of gas through it from the two gas sources with which bore 78 is in open flow communication with. By the use of a restrictor having predetermined material and porosity characteristics, it is assured that gas at a pressure sufficiently high from one of at least two locations that are continuously available to it is directed to the slide valve actuating cylinder to urge the slide valve in a direction which loads the compressor under all conditions within the compressor's operating envelope.

Figure 3:
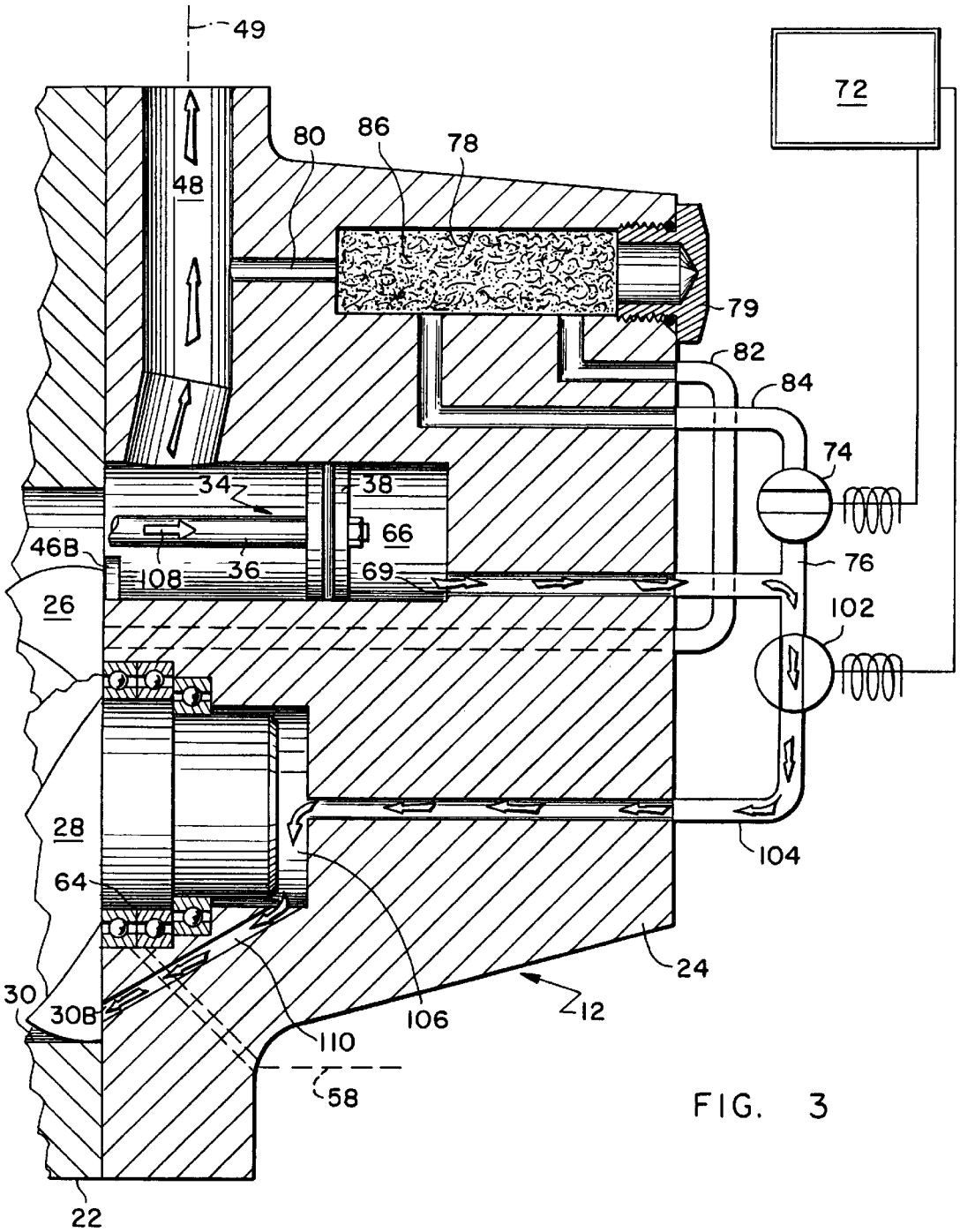
FIG. 3 is an enlarged view of the bearing housing of the compressor of FIG. 1 showing an open unload solenoid and the venting of slide valve actuating fluid to a relatively lower pressure location within the compressor in order to unload the compressor.

Referring primarily now to FIGS. 3 and 4, the unloading of compressor 12 is illustrated. Under circumstances calling for reduced compressor capacity, load solenoid valve 74 is closed and unload solenoid valve 102 is opened by controller 72. The positioning of unload solenoid valve 102 to the open position places slide valve actuating cylinder 66 in flow communication with a location within compressor 12 through passages 76 and 104, such as bearing cavity 106, which is preferably at or near suction pressure when the compressor is operating.

The opening of unload solenoid valve 102 therefore vents cylinder 66 and the relatively much higher pressure gas contained within it to a relatively much lower pressure location within the compressor assembly. That causes slide valve assembly 34 to move in the direction of arrow 108 to unload the compressor.

In that regard, the surface areas of the slide valve assembly are designed such that the net effect of the gas forces acting on them, under the circumstance where cylinder 66 is vented, is to urge the slide valve assembly in a direction which unloads the compressor. The closure of unload solenoid valve 102 stops the movement of slide valve assembly 34 in that direction and maintains the position of the slide valve and the reduced load on the compressor constant until the next opening of either the load or unload solenoid valves.

Bearing cavity 106 preferably drains or vents, such as through passage 110 and opening 30B (shown in phantom in FIG. 4), to a so-called "idling" pocket within the working chamber of the compressor which is at or near suction pressure. Such a pocket is a closed pocket, that is, a gas-containing pocket closed off from suction, in which the compression process has not yet begun to occur. Oil drained or vented into such a pocket is carried back to the oil separator as the gas in that pocket is compressed and forced out of the working chamber through the discharge port.

Figure 5:
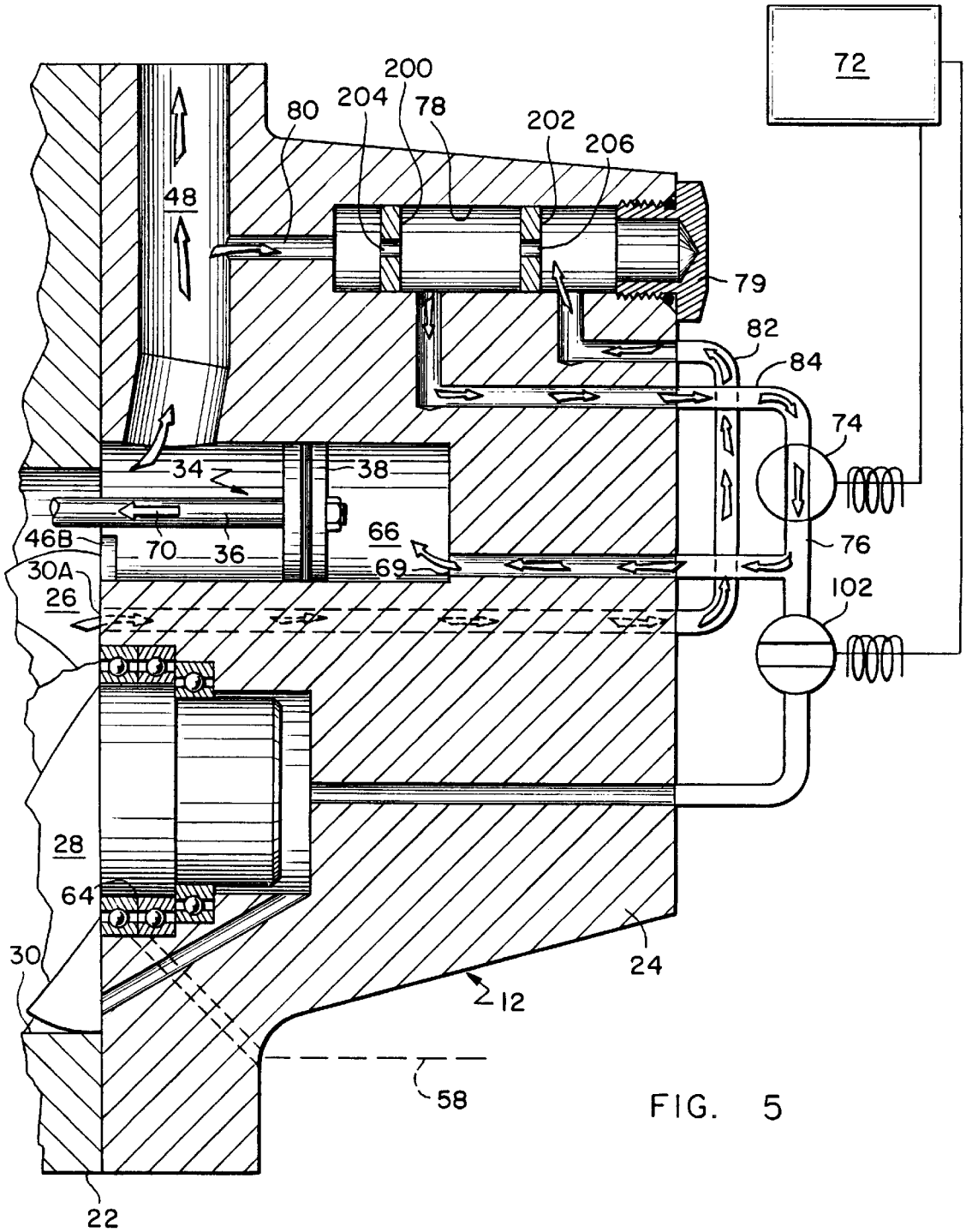
FIG. 5 is a view comparable to FIG. 2 but illustrating an alternate embodiment thereto.

Referring now to the alternate embodiment of FIG. 5, plug 86 is replaced in this embodiment with a first restrictor 200 and a second restrictor 202 which define a first orifice 204 and a second orifice 206 respectively. Restrictor 200 is disposed between passage 80 and passage 84. Likewise, restrictor 202 is disposed between passage 82 and passage 84. Therefore, gas flowing out of passages 80 and/or 82 into bore 78 must first pass through orifice 204 or 206 respectively in order to proceed to and through passage 84.

The pressure of the gas which is permitted to flow through restrictors 200 and 202 is determined by the size of their respective orifices. In each case, orifice sizing is predetermined in accordance with the operating characteristics of the compressor to ensure that under all conditions within the compressor's operating envelope, gas is available to the slide valve operating cylinder from a location which is at a pressure sufficient to urge the slide valve assembly in a direction which loads the compressor.

It will be appreciated that as compressor operating conditions vary, the source of the gas by which the slide valve is actuated will shift from one source to the other as the pressure of the gas in the at least two source locations changes such that the pressure becomes higher in one source location than it is in the other. Under so-called normal compressor operating conditions, the gas used to actuate the slide valve in order to load the compressor will typically be gas sourced from downstream of the compressor's working chamber. Under conditions where gas in the compressor's working chamber is at a pressure higher than the gas immediately downstream of the compressor's discharge port, the source of gas for slide valve actuation will shift to the working chamber without any need for proactive control and without the need to shift the position of or move any part or component in the compressor or the system in which it is employed.

Overall, gas actuation of the slide valve assembly at system startup is far more quickly and reliably achieved in the compressor of the present invention in a manner which overcomes the adverse affects of both refrigerant gas outgassing and gas bubble collapse which are found in hydraulic slide valve actuating arrangements. The present invention also makes advantageous use of refrigerant gas overcompression at a time when slide valve responsiveness is critical to the safe, reliable and continued operation of the compressor.

By use of refrigerant gas from within the system in which the compressor is employed to gas actuate rather than hydraulically actuate a compressor slide valve and by the use of overcompression which occurs within the compressor under certain operating conditions, successful and immediate actuation of a screw compressor capacity control slide valve under so-called hot start conditions is achievable. Hot start conditions occur when the temperature differential between the system condenser and the system evaporator at compressor startup is such that it is difficult to build sufficient pressure in the oil separator to ensure an adequately pressurized supply of oil to the compressor in a timely manner. In that regard, a successful "hot start" is considered to be achieved when a predetermined differential suction to discharge pressure is achieved which is sufficient to drive oil to the compressor prior to the time a differential pressure safety control would otherwise shut down the compressor.

The compressor of the present invention has been successful in achieving "hot starts" in a laboratory setting where the condenser temperature was 32° F. below the evaporator temperature at startup. By way of contrast, prior hydraulically actuated slide valve actuation schemes often required that condenser temperatures be at least 10° F. above evaporator temperature to assure a successful start, that is, a start in which pressure develops quickly enough in the oil separator to assure an adequately pressurized supply of oil to the compressor in a timely manner.

It is also to be noted that an additional advantage of the gas actuation arrangement of the present invention is that its implementation can be accomplished through the use of flow passages formed only in the bearing housing and passages which do not need to be aligned with or communicate with passages in the rotor housing of the compressor. It is still further to be noted that the present invention is equally applicable to the control of slide valves and screw compressors of types other than capacity control slide valves. For instance, the slide valve actuation arrangement of the present invention is applicable to the control of so-called volume ratio control slide valves as well as to the control of multiple slide valves in a screw compressor whatever their purpose, number or type might be.

As has also been noted, the compressor of the present invention is more predictably and accurately controlled due to the consistency of refrigerant gas, when employed as an actuating fluid, as compared to the relatively inconsistent makeup, in terms of entrained gas bubbles and/or dissolved refrigerant, of the hydraulic fluid most typically used in such applications. As a result of the consistency of the gaseous medium used to control the position of the slide valve assembly in the present invention, much more precise and repeatable control of slide valve position is achieved and compressor efficiency is enhanced.

While the present invention has been described in terms of both a preferred and alternative embodiment, it will be appreciated that still other embodiments, falling within the scope of the invention as claimed, will be apparent to those skilled in the art and are contemplated hereby.

What is claimed is:

1. A refrigeration screw compressor, having a suction and a discharge port, comprising:

a housing, said housing defining a working chamber in flow communication with said suction and said discharge ports of said compressors;

a male rotor disposed in said working chamber;

a female rotor disposed in said working chamber in meshing engagement with said male rotor, rotation of said male and said female rotors operating to compress a gaseous working fluid within said working chamber from a suction to a discharge pressure;

a slide valve, said slide valve having an actuating piston;

a first source of gas for loading said compressor;

a second source of gas for loading said compressor; and valve means interposed between said piston and said first and said second gas sources, both of said first and said second gas sources being placed in flow communication with said piston, when said valve means is open, so as to load said compressor.

2. The compressor according to claim 1 wherein the pressure of at least one of said first and said second sources of gas equals or exceeds the pressure to which gas is compressed in the working chamber of said compressor when said compressor is in operation.

3. The compressor according to claim 2 wherein the flow of gas through said compressor is in a direction from said suction port, into said working chamber and out of said discharge port, said first source of gas being downstream of said discharge port.

4. The compressor according to claim 3 further comprising means for restricting the flow of gas from said first and said second gas sources to said piston, said means for restricting flow being downstream of both said first and said second sources of gas but upstream of said valve means.

5. The compressor according to claim 4 wherein said second source of gas is said working chamber.

6. The compressor according to claim 5 wherein said housing defines a discharge passage downstream of said discharge port and an actuating cylinder in which said slide valve actuating piston is disposed, said discharge passage being said first source of gas, said compressor having a first passage in communication with said discharge passage and with said actuating cylinder when said valve means is open and a second passage in communication with said working chamber and with said actuating cylinder when said valve means is open, said first and said second passages converging upstream of said valve means.

7. The compressor according to claim 6 wherein said second source of gas is a closed compression pocket defined in said working chamber, said second passage communicating between said closed compression pocket and with said actuating cylinder when said valve means is open.

8. The compressor according to claim 7 wherein said means for restricting flow is porous and is in continuous open flow communication with said first and said second sources of gas, gas from said first and said second sources of gas being constrained to flow through said means for restricting flow in order to flow to said actuating cylinder.

9. The compressor according to claim 8 wherein said means for restricting flow is a sintered plug.

10. The compressor according to claim 6 wherein said means for restricting flow is comprised of a first restrictor and a second restrictor, gas flowing from said first source of gas through said first passage being constrained to flow through said first restrictor prior to flowing to said actuating cylinder, gas flowing from said second source of gas through said second passage being constrained to flow through said second restrictor prior to flowing to said actuating cylinder.

11. A refrigeration system comprising:

an oil separator;

a condenser;

a metering valve;

an evaporator; and a screw compressor, said screw compressor compressing, in operation, a gaseous working fluid from a suction to a discharge pressure in a working chamber which is in flow communication with a suction and a discharge port, said compressor having a slide valve that is caused to move in a direction which loads said compressor by gaseous working fluid sourced from at least one of at least two locations within said refrigeration system, both of said at least two locations being placed in open communication with said slide valve to further load said compressor.

12. The refrigeration system according to claim 11 wherein said slide valve has an actuating piston and further comprising valve means interposed between said actuating piston and said at least two source locations for gaseous working fluid, said slide valve being actuated to further load said compressor when said valve means is open, both of said at least two source locations for gaseous working fluid being in flow communication with said piston when said valve means is open.

13. The refrigeration system according to claim 12 wherein the flow of gas through said refrigeration system is from said evaporator to said suction port of said screw compressor, then into and through said working chamber of said screw compressor and then out of said working chamber through said discharge port of said screw compressor, the first of said at least two source location for gaseous working fluid being downstream of said discharge port of said screw compressor.

14. The refrigeration system according to claim 13 wherein the second of said at least two source locations for gaseous working fluid is downstream of said suction port but upstream of said discharge port of said screw compressor.

15. The refrigeration system according to claim 14 wherein said second source location for gaseous working fluid is a closed compression pocket in said working chamber.

16. The refrigeration system according to claim 15 further comprising means for restricting the flow of gas from said at least two source locations for gaseous working fluid, said means for restricting flow being downstream of both of said at least two source locations but upstream of said valve means.

17. The refrigeration system according to claim 16 wherein the pressure of at least one of said at least two source locations for gaseous working fluid at least equals the pressure to which gaseous working fluid is compressed in said working chamber when said compressor is in operation.

18. The refrigeration system according to claim 17 wherein said screw compressor defines a discharge passage downstream of said discharge port and wherein said refrigeration system includes an actuating cylinder, said slide valve piston being disposed in said cylinder and said discharge passage being said first source location for gaseous working fluid, said compressor defining a first passage communicating with said first source location and a second passage communicating with said second source location.

19. The refrigeration system according to claim 18 wherein said first and said second passages converge upstream of said valve means and wherein said means for restricting flow is porous and is in continuous open flow communication with both said first passage and with said second passage, gas from both of said at least two source locations for gaseous working fluid being constrained to flow through said means for restricting flow in order to flow to said slide valve actuating cylinder.

20. The refrigeration system according to claim 19 wherein said means for restricting flow is a sintered plug.

21. The refrigeration system according to claim 18 wherein said means for restricting flow is comprised of a first restrictor and a second restrictor, gas flowing from said first source of gas through said first passage being constrained to flow through said first restrictor prior to flowing to said actuating piston, gas from said second source of gas through said second passage being constrained to flow through said second restrictor prior to flowing to said actuating piston.

22. The refrigeration system according to claim 15 wherein said second source location for working fluid is said oil separator.

23. The refrigeration system according to claim 15 wherein said second source location for gaseous working fluid is downstream of said compressor but upstream of oil separator.

24. A method of controlling the position of a piston actuated slide valve in a refrigeration screw compressor which compresses a gaseous working fluid from a suction to a discharge pressure in a working chamber having a suction and a discharge port comprising the steps of;

supplying said gaseous working fluid to said compressor at a suction pressure;

compressing said gaseous working fluid in the working chamber of said compressor;

discharging said gaseous working fluid from said working chamber of said compressor through said discharge port at a discharge pressure; and controlling the position of the slide valve, so as to load said compressor, using said gaseous working fluid, said gaseous working fluid for loading said compressor being sourced from at least one of at least two locations in said compressor, both of said at least two locations being placed in flow communication with the actuating piston of said slide valve in order to further load said compressor.

25. The method according to claim 24 wherein said controlling step includes the step of sourcing said working fluid from downstream of said discharge port and from said working chamber.

26. The method according to claim 25 wherein said controlling step includes the step of restricting the flow of gaseous working fluid to said slide valve actuating piston.

27. The method according to claim 26 wherein said sourcing step includes the steps of defining passages in said compressor which are in open communication with each of said at least two source locations for gaseous working fluid and causing said passages to converge upstream of said slide valve actuating piston.

28. A method of controlling the position of a piston actuated slide valve in a refrigeration screw compressor which compresses a gaseous working fluid from a suction to a discharge pressure in a working chamber having a suction and a discharge port and where the gaseous working fluid is used to actuate said slide valve comprising the steps of:

providing a first source location for gaseous working fluid by which to load said compressor;

providing a second source location for gaseous working fluid by which to load said compressor;

compressing gaseous working fluid in the working chamber of said compressor;

discharging compressed gaseous working fluid from said working chamber through said discharge port; and placing both said first and said second source locations in flow communication with said slide valve so as to cause said slide valve to move in a direction which loads said compressor.

29. The method according to claim 28 wherein said compressor defines a discharge passage downstream of said discharge port, said discharge passage being said first source location, wherein said second source location is said working chamber and comprising the further steps of defining a first passage between said discharge passage of said compressor and said slide valve and defining a second passage between said working chamber and said slide valve.

30. The method according to claim 29 comprising the further step of restricting the flow of gas from said first and said second source locations to said slide valve.

31. The method according to claim 30 comprising the further step of causing said first and said second passages to converge upstream of said slide valve.

32. The method according to claim 31 wherein said restricting step includes the step of restricting the flow of working fluid from said discharge passage to said slide valve by the use of a first restrictor and the step of restricting the flow of gas from said working chamber to said slide valve by the use of a second restrictor.

* * * * *